US005547074A

United States Patent [19]

Plaxico et al.

[11] Patent Number: 5,547,074

[45] Date of Patent: Aug. 20, 1996

[54] ARTICLE CARRIER

[75] Inventors: Bob E. Plaxico, Lithonia; James W. Wright, Woodstock, both of Ga.; Philippe Domansky, Chateauroux, France

[73] Assignee: The Mead Corporation, Dayton, Ohio

[21] Appl. No.: 326,987

[22] Filed: Oct. 21, 1994

[51] Int. Cl.[6] ..... B65D 75/00

[52] U.S. Cl. ..... 206/193; 206/162; 206/187

[58] Field of Search ..... 206/162, 170, 206/174, 175, 180, 185, 186, 187, 188, 198, 427, 193

[56] References Cited

U.S. PATENT DOCUMENTS

| | | | |
|---|---|---|---|
| D. 163,033 | 4/1961 | Forrer . | |
| D. 184,999 | 4/1959 | Hodgman . | |
| D. 274,573 | 7/1984 | Torokvei . | |
| 2,395,711 | 2/1946 | Arnold . | |
| 2,431,713 | 12/1947 | Stigler . | |
| 2,433,676 | 12/1947 | Ringler . | |
| 2,537,452 | 1/1951 | Forrer | 206/188 |
| 2,785,827 | 3/1957 | Forrer . | |
| 2,913,101 | 11/1959 | Daily . | |
| 2,974,827 | 3/1961 | Levkoff . | |
| 3,204,815 | 9/1965 | Weiss | 206/186 X |
| 3,326,411 | 6/1967 | Crouch | 206/187 |
| 3,334,783 | 8/1967 | Plaxico . | |
| 3,572,542 | 3/1971 | Wood et al. | 206/188 X |
| 3,572,543 | 3/1971 | Forrer et al. | 206/188 X |
| 3,572,545 | 3/1971 | Stout | 206/188 |
| 3,624,790 | 11/1971 | Stout . | |
| 3,627,193 | 12/1971 | Helms . | |
| 3,669,306 | 6/1972 | Forrer | 206/188 |
| 3,698,151 | 10/1972 | Arneson . | |
| 3,721,368 | 3/1973 | Arneson . | |
| 3,747,294 | 7/1973 | Calvert et al. . | |
| 3,751,872 | 8/1973 | Helms . | |
| 3,757,991 | 9/1973 | Stout | 206/187 X |
| 3,760,555 | 9/1973 | Calvert . | |
| 3,766,837 | 10/1973 | Forrer . | |
| 3,848,519 | 11/1974 | Ganz . | |
| 3,850,292 | 11/1974 | Manizza et al. . | |
| 3,893,565 | 7/1975 | Rossi et al. . | |
| 3,917,061 | 11/1975 | Stout | 206/187 |
| 3,940,907 | 3/1976 | Ganz . | |
| 4,029,205 | 6/1977 | Wood . | |
| 4,403,727 | 9/1983 | Grieve et al. . | |
| 4,782,944 | 11/1988 | Engdahl, Jr. . | |
| 4,802,324 | 2/1989 | Everson . | |
| 4,915,218 | 4/1990 | Crouch et al. . | |
| 4,919,261 | 4/1990 | Lashyro et al. . | |
| 5,234,103 | 8/1993 | Schuster . | |

FOREIGN PATENT DOCUMENTS

| | | |
|---|---|---|
| 663694 | 5/1963 | Canada . |
| 1266616 | 6/1961 | France . |
| 1014008 | 12/1965 | United Kingdom . |

*Primary Examiner*—Bryon P. Gehman
*Attorney, Agent, or Firm*—Michael V. Drew

[57] ABSTRACT

A collapsible basket-type article carrier has end walls joined at the ends of opposing side walls. A portion of the side wall is cut-away to form bands for engaging articles. Riser panels extend inwardly of the end walls. A handle structure extends between the end walls and riser panels. A center cell partition extends from each respective side wall to the handle structure. The corner formed at each intersection of the carton's side and end walls is bevelled. In like manner, the corner formed at each intersection of a band of the center cell and the side wall portion thereof is bevelled. Support tabs join either the riser panels or end walls to the bottom wall of the carrier. The bottom wall of the carrier is bifurcated. Bottles are loadable upwardly through the open bottom of the carrier. In collapsed condition the carrier has a shearable nick members strategically located upon cut lines between the side wall and center cell at the bevelled corner tabs. A blank for forming the carrier contains the elements described above. The support tabs are foldably joined to respective riser panels on one version of the blank. In an alternate version of a blank the support tabs are foldably joined to respective end panels.

12 Claims, 5 Drawing Sheets

ARTICLE CARRIER

BACKGROUND OF THE INVENTION

The invention relates generally to article carriers, and more particularly to a bottom-loading basket-style article carrier for closely receiving articles such as bottles.

Basket-style article carriers, such as carriers for soft-drink bottles, are useful for several reasons. For example, articles may be easily removed from the carrier, articles may generally be easily replaced in the carrier after removal for transport, disposal or other purposes, the carrier generally has an easy-to-use handle economically integrally formed with the carrier, and the carrier is generally perceived to be aesthetically pleasing to consumers. Basket-type carriers are typically designed to loosely receive the articles. A basket-style article carrier for bottles is generally constructed to loosely receive the bottles so that glass bottles in particular may be easily loaded and unloaded repeatedly, if desired, and also so that breakable bottles may be better separated from one another. What is needed, however, is a carrier particularly suited for closely receiving articles, such as bottles, in a manner that facilitates production of a tight package. A snug carrier package is particularly useful for packaging non-breakable bottles, such as PET bottles commonly used in the soft-drink beverage industry, which do not need to be segregated in a package.

Some known basket-style carriers have center cells, and high center cells in particular. A center cell is typically used to segregate breakable bottles as well as help support bottles. A center cell would be useful in packaging nonbreakable bottles to help produce a close fit between the carrier and the centrally-located bottles in the carrier, as well as to help support the bottles.

SUMMARY OF THE INVENTION

The present invention provides an article carrier for closely receiving articles such as bottles. In a preferred embodiment of the invention a collapsible basket-type article carrier has end walls joined at the ends of opposing side walls. A portion of the side wall is cut-away to form bands for engaging articles. Riser panels extend inwardly of the end walls. A handle structure extends between the end walls and riser panels. A center cell partition extends from each respective side wall to the handle structure. The corner formed at each intersection of the carton's side and end walls is bevelled. In like manner, the corner formed at each intersection of a band of the center cell and the side wall portion thereof is bevelled. Support tabs join either the riser panels or end walls to the bottom wall of the carrier. The bottom wall of the carrier is bifurcated. Bottles are loadable upwardly through the open bottom of the carrier. In collapsed condition the carrier has shearable nick members strategically located upon cut lines between the side wall and center cell at the bevelled corner tabs.

The preferred embodiment of the invention also provides a blank for forming the above-described carrier embodiment. The blank contains the elements described above. The support tabs are foldably joined to respective riser panels on one version of the blank. In an alternate version of a blank according to a preferred embodiment the support tabs are foldably joined to respective end panels.

Other advantages and objects of the present invention will be apparent from the following description, the accompanying drawings, and the appended claims.

DETAILED DESCRIPTION OF THE PREFERRED EMBODIMENT

Figure 1:
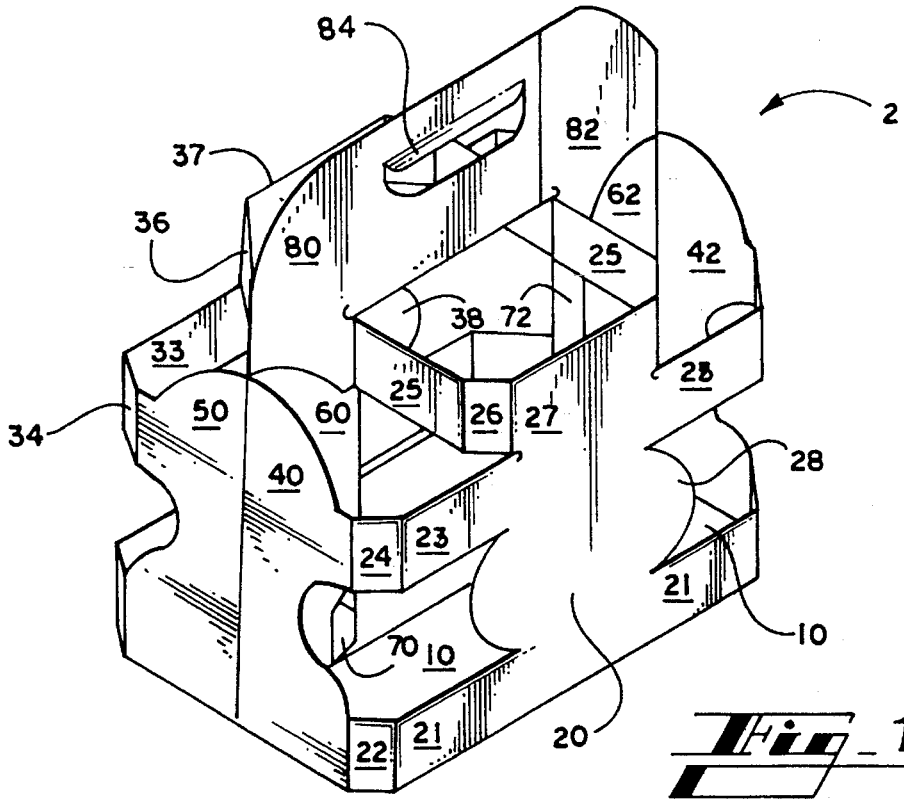
FIG. 1 is an isometric illustration of an article carrier in accordance with a preferred embodiment of the present invention.

The features of an erected article carrier 2 according to a preferred embodiment of the invention will be first described with reference simultaneously to the isometric illustration of FIG. 1 and the side elevational view of FIG. 2. The carrier 2 illustrated is generally designed to accommodate two rows of three bottles each, although the invention is also easily practiced to accommodate rows of other multiples of bottles. For example, two rows of four bottles per row. Both sides of the carrier are the same. Thus, the features described with respect to the side shown in FIG. 2 in particular and FIG. 1 generally are equally applicable to the unseen side. The side wall 20, 30 has a cut-out portion that generally defines a lower side wall band 21, 31 and an upper side wall band 23, 33. Foldably connecting the lower 21, 31 and upper 23, 33 bands to respective end walls 40, 42, 50, 52 are respective corner tabs 22, 32, 24, 34. The corner tabs 22, 32, 24 34 respectively form bevelled corners at the intersections of the side walls 20, 30 and end walls 40, 42, 50, 52. The cut-way area also defines a center portion 28, 38 left intact in the side wall 20, 30. A center cell is formed on each side of the carrier by cell bands 25, 35 corner tabs 26, 36 foldably connected to the cell bands and a central cell portion 27, 37 integrally formed with the side wall 20, 30. Riser panels 60, 62, 70, 72 extend between the bottom of the carrier 2 and the handle structure formed by panels 80, 82, 90, 92. A handhold flap 84 is also visible from the side view shown. Cut lines between center cell portions of side walls 20, 30 and respective handle structure panels 80, 82, 90, 92 terminate in respective curved cut lines 86, 88, 96, 98. Cut lines between the upper bands 23, 33 of respective side walls 20, 30 and corresponding center cell portions terminate in respective curved cut lines 87, 89, 97, 99. In collapsed condition the carrier 2 has nick members strategically located upon cut lines between the side wall and center cell at the bevelled corner tabs. This feature is not evident in the fully erected carrier but will be discussed in greater detail in the context of blanks for forming the carrier, below.

Figure 2:
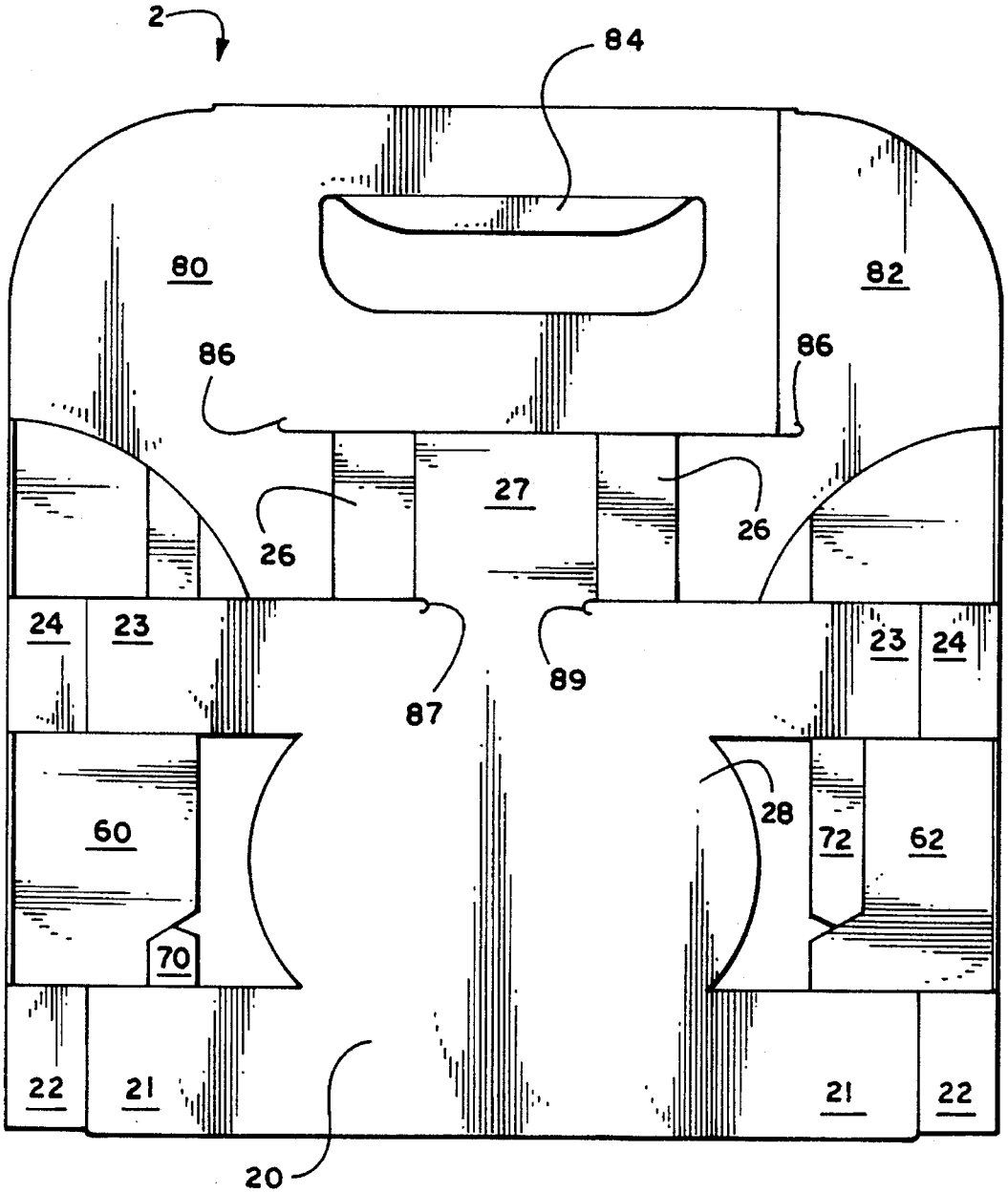
FIG. 2 is a front elevational view of the carrier of FIG. 1.
Figure 3:
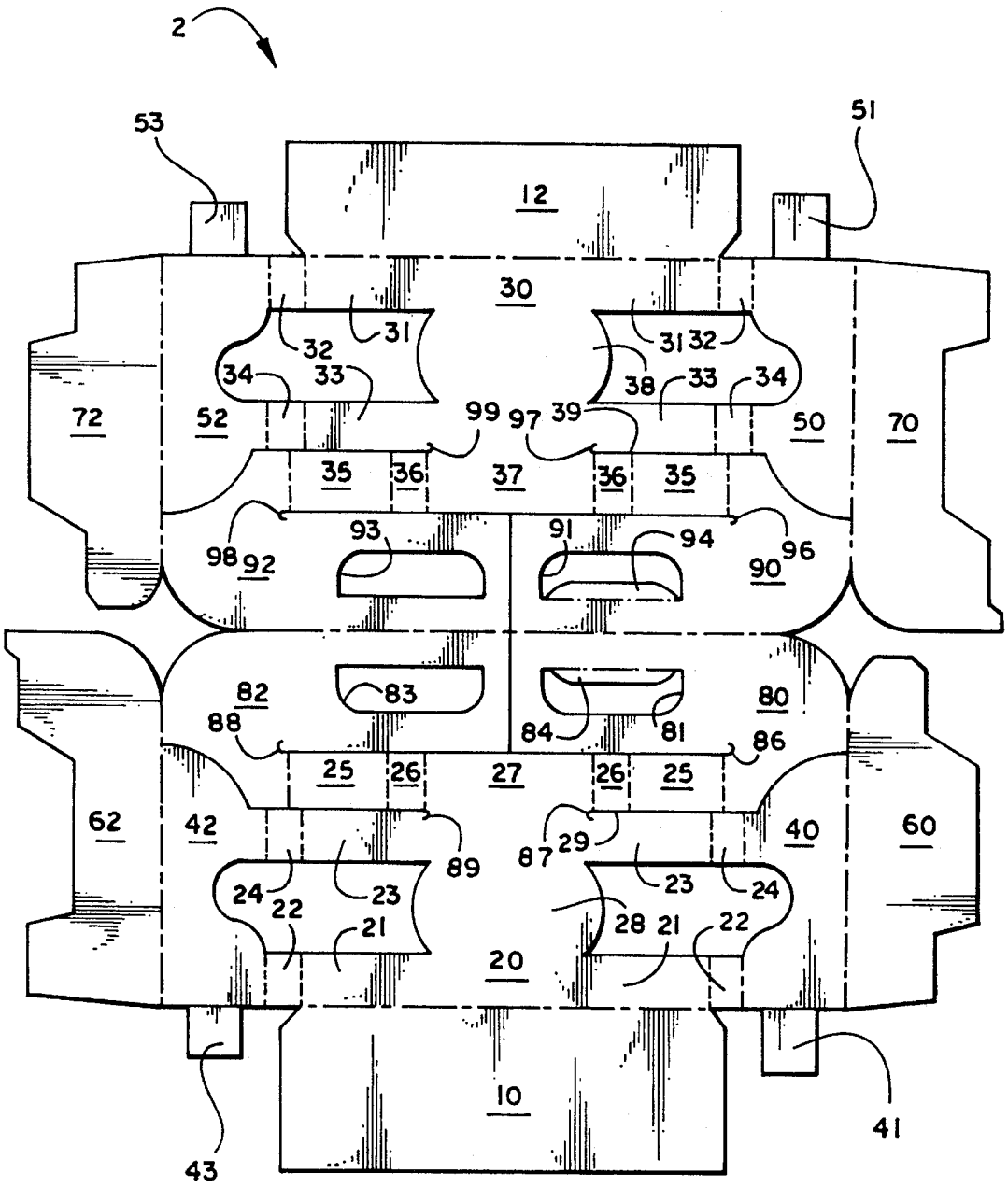
FIG. 3 is a plan illustration of a blank for forming the carton of FIG. 1 in accordance with a preferred embodiment of the present invention.

Referring now to FIG. 3, therein is illustrated a blank 4, according to a preferred embodiment of the invention, for forming the erected carrier of FIG. 1. The blank 4 is essentially symmetric about a perforated fold line dividing the handle panels 80, 82, 90, 92, and halves, of the carrier from one another. One of the two bottom walls 10, 12 is widthwise greater than the other and for convenience is designated the greater bottom wall 10. The other bottom wall is conveniently designated the lesser bottom wall 12. Each side wall 20, 30 has a cut-out or cut-away area which helps define a lower side wall band 21, 31 and adjacent corner tabs 22, 32, and a top band 23, 33 and adjacent corner tabs 24, 34. Elements for forming a center cell are central cell bands 25, 35, central cell corner tabs 26, 36 and center cell central portions 27, 37 which are integral with the respective side walls 20, 30. A solid nick member 29, 39 is positioned along one of the respective cut lines between corresponding ones of the top bands 23, 33 and respective center cell bands 25, 35 and accompanying center cell corner tabs 26, 36. The nick member 29, 39 connects an adjacent top side wall band 23, 33 and center cell corner tab 26, 36. End walls 40, 42, 50, 52 lie adjacent respective side walls 20, 30 connected thereto by respective side wall corner tabs 22, 32, 24, 34. Support tabs 41, 43, 51, 53 are connected to respective end walls 40, 42, 50, 52 along fold lines. Riser panels are connected to respective end walls 40, 42, 50, 52 along perforated fold lines. The center cell bands 25, 35 are connected along perforated fold lines to the lower portions of respective handle panels 80, 82, 90, 92. Hand holes 81, 83, 91, 93 are formed in the respective handle panels 80, 82, 90, 92. Cut lines separating center cell bands 25, 35 and accompanying center cell corner tabs 26, 36 from respective handle panels terminate in curved cut lines 86, 88, 96, 98. Cut lines separating the top bands 23, 33 and accompanying corner tabs 24, 34 from respective center cell bands 25, 35 and accompanying center cell corner tabs 26, 36 terminate in curved cut lines 87, 89, 97, 99 in the respective side walls 20, 30. Handhold flaps 84, 94 are connected along perforated fold lines to respective handle panels 80, 90 within the respective hand holes 81, 91 thereof. Curved cut lines 86, 87, 88, 89, 96, 97, 98, 99 help direct stress away from strategic termination points of cut lines in the carrier and blanks therefor. The stippling shown on the blank 4 represents glue applied in preparation for the first step of folding the blank into a carrier 2.

Figure 5:
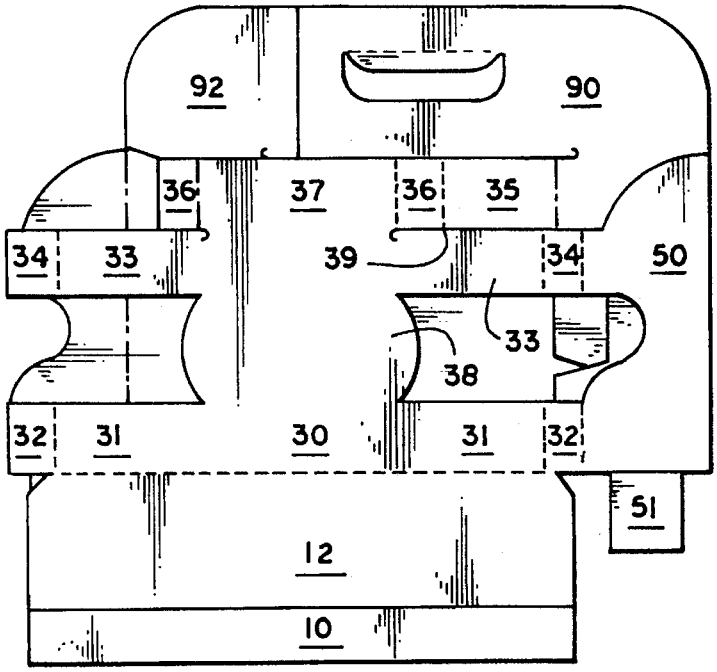
FIG. 5 is a plan view of the collapsed carrier corresponding to the erect carrier of FIG. 1 formed from the blank of FIG. 3.
Figure 4:
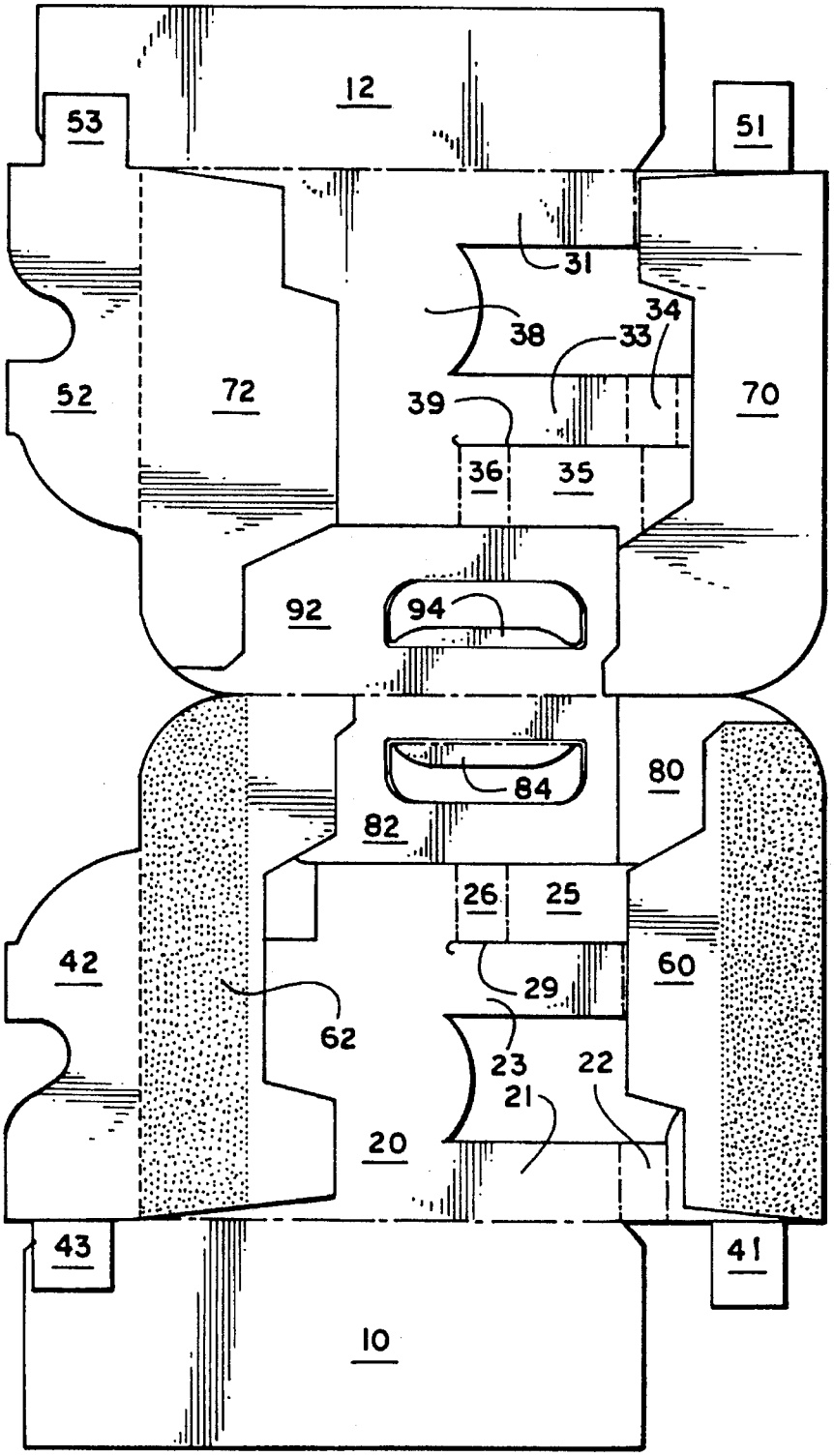
FIG. 4 is a plan view depicting an intermediate stage of folding of the blank of FIG. 3.

FIG. 4 depicts the blank of FIG. 3 partially folded and additional glue applied, as indicated by the stippling, in preparation for further folding. FIG. 5 illustrates the blank 4 glued and folding into a collapsed form of the carrier 4 of FIG. 1.

Figure 6:
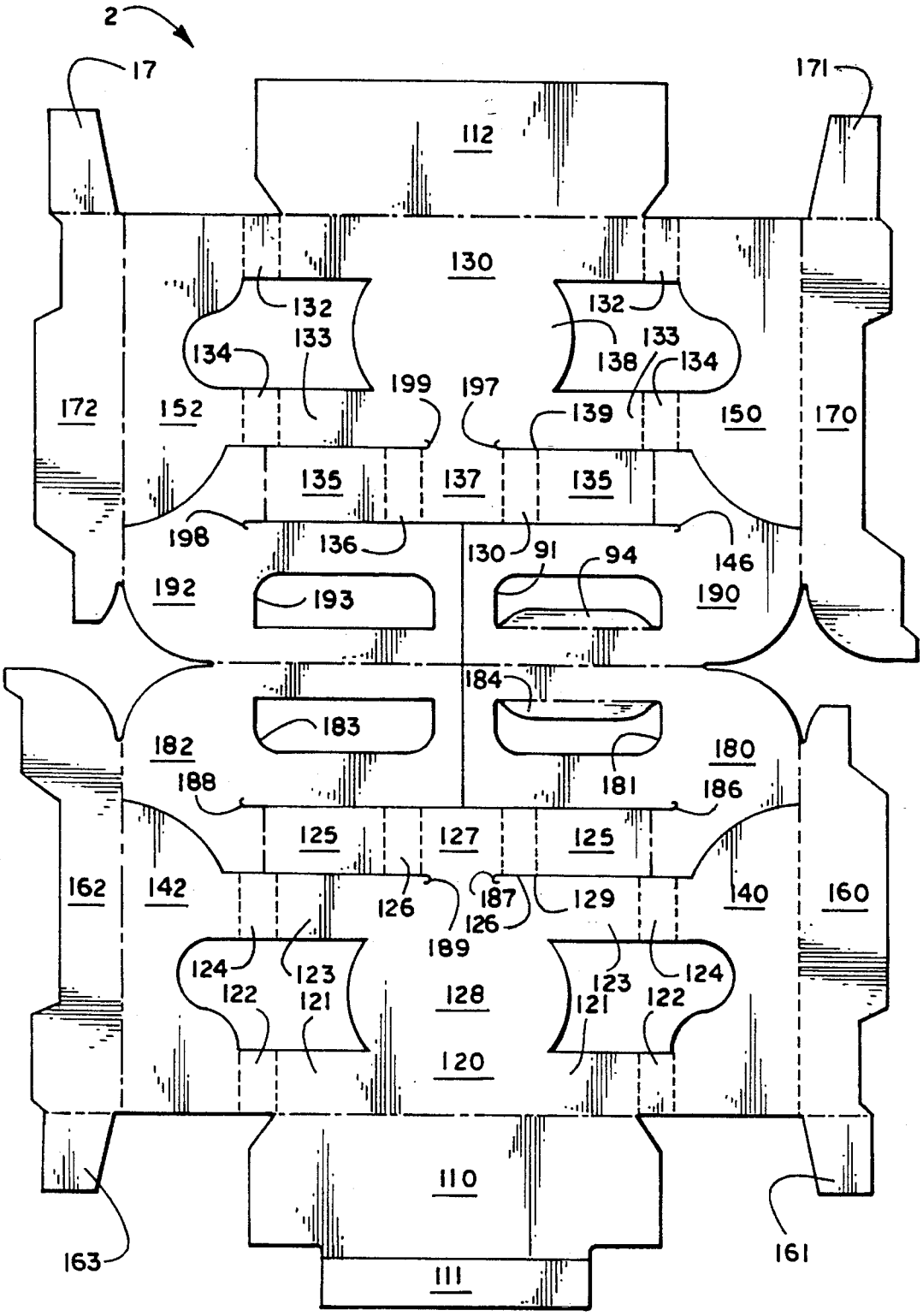
FIG. 6 is a plan view of an alternate blank for forming the carrier of FIG. 1 in accordance with a preferred embodiment of the present invention.

FIG. 6 illustrates an alternate blank 6 for forming the carrier 2 of FIG. 1. The blank of FIG. 6 differs from the blank of FIG. 3 in that the support tabs 161, 163, 171, 173 of the blank of FIG. 6 are located upon respective riser panels 160, 162, 170, 172 rather than end walls. The other features of the two blanks are essentially the same. Thus, the numbers used to identify features in the blank of FIG. 6 are the same as those used in FIG. 3 in a 100 series. That is, the numerals of FIG. 3 are preceded by a "1" in FIG. 6.

Particularly in the case of a contoured bottle such as the proprietary contoured bottle in which Coca-Cola® brand soft drink is sold, the bands engage the wider-circumference bottom and center portion of the bottle. The top band 23 also serves to obscure the UPC symbol that is placed on individual bottles of product so that only the pricing symbol on the carrier may be scanned at a store register. The combination of bands 21, 23 and the center portion 28 provide support and visibility of product while also facilitating a tightly packed package. The center portion 28, 38 helps maintain the structural stability of the carrier and provides a display surface. Although the carrier 2 may be constructed without the cut-out portion, the bands 21, 23 formed by the cut-out more definitively engage the walls of a bottle placed in the carrier at the locations of the bands.

In the drawings of the blanks 4, 6 dotted lines represent perforated fold lines. Solid lines represent cut lines except that the solid lines between respective support tabs 41, 43, 51, 53, 161, 163, 171, 173 and the remainder of the blank 4, 6 represent creased fold lines. Each blank 4, 6 can be folded as described above to form the carrier of FIG. 1. Although the carrier 2 may be used to package many different types of articles, it is particularly suitable for packaging flexible PET bottles in a tight package. This particular suitability is even more applicable in the case of plastic bottles contoured to have a tapered segment between a bottom and upper area of greater diameter. The bevelled corners of the side and end walls which work in conjunction with the bevelled corners of the center cell permit the package formed by the carrier to be tightly loaded. For example, the invention contemplates that a suitable method of creating a package with the carrier 2 is to open the carrier from the collapsed position indicated in FIG. 5, then either impel the carrier downward over a group of bottles or impel bottles upward into the carrier, or some combination of these two methods. In this manner once the carrier 2 is generally opened the tapered tops of bottles (as most bottles are configured) easily fit through the bottom opening of the carrier. As the bottles are moved upwardly into the opened carrier the walls of the carrier are engaged by the bottles and pushed outwardly creating a snug fit. The bevelled corners of each side wall 20, 30 and the bevelled corners of the center cell work in tandem to closely receive curved bottles and thus assure a snug package of bottles. The bevelled corners of the center cell add to the snug fit desired because a tighter package is achieved when each corner of the carrier which engages a bottle is diagonally aligned to accommodate the circumference of the bottle. The lower side wall bands 21, 31 of the respective side walls 20, 30 effectively engage the base of bottles. The upper side wall bands 23, 33 and the center cell bands are strategically located to engage the upper portions of bottles.

The invention anticipates opening of the carrier 2 from a collapsed condition (as illustrated in FIG. 5) by pulling each side wall panel 20, 30 perpendicularly outwardly of the plane of the handle structure 90, 29 until the carrier essentially achieves the erected structure depicted in FIG. 1. As previously mentioned, the carrier 2 can produce an extremely snug package. In loading the carrier 2 with bottles, once the side walls 20, 30 are pulled outward bottles are loaded upwardly through the bottom thereof. Because bottles loaded into the carrier are closely received by the walls of the carrier it is important that the tops of bottles not be obstructed by the carrier during loading. The nick members 29, 39 provide sufficient bonding between the center cell portion and side wall to delay the formation of one of the bevelled corners of the center cell. Since the bevelled corners of the carrier facilitate a snug fit, delaying forming of one of the bevelled corners likewise delays achieving a close fit. A loaded bottle is more easily received by the center cell and provides less of an obstruction to loading prior to formation of both bevelled corners. The nick members 29, 39 thus facilitate loading of the carrier 2 by delaying formation of one of the bevelled corners of the center cell until a bottle is at least partially positioned in the cell. The nick members 29, 39 are placed on the side walls 20, 30 on either side of the carrier. Although any of the junctures of a side wall band 23, 33 and respective center cell corner tab 26, 36 may contain a nick member loading. Loading of the carrier 2 is made easier and symmetrically attainable when the nick members 29, 39 lie at the same end of the carrier. Each nick member 29, 39 is a solid point of material on the cut line between one upper band of the side wall 23, 33 and the juncture of a corresponding diagonal corner tab 26, 36 and band 25, 35 of the center cell. The nick member 29, 39 is of a small enough dimension that it remains intact initially upon opening of the carrier but subsequently easily tears when the carrier is subjected to the stress of fully receiving and encompassing the loaded bottles. When the nick member 29, 39 tears the bevelled corner tabs 26, 36 detach from the upper wall band 23, 33 and form one of the bevelled corners of the center cell. An example of a suitable nick member dimension is a nick member having a length of 0.004" in a paperboard carrier having a thickness of between 0.018" to about 0.024".

The support tabs of the blank 4 shown in FIG. 3 (41, 43, 51, 53) and the blank 6 of FIG. 6 (161, 163, 171, 173) are affixed to the respective proximate bottom wall panels (10, 12, 110, 112) of the erected carrier to provide additional support for the constructed bottom wall. As previously mentioned, the blanks 4, 6 differ only in the location of the respective support tabs. The selection of support tabs may be affected by the choice of machinery employed to erect and load the carriers in a package. Although the use of a single support tab will help stabilize the carrier, the use of two support tabs at each end of the carrier help to enhance the stability of the carrier whether empty or full. In the blank 4 of FIG. 3, the support tabs 41, 51 at one end of the blank 4 (and thus ultimately the carrier 2) are illustrated longer than the support tabs 43, 53 at the opposite end of the blank 4 to demonstrate a distinction in length to be utilized in the manipulation of the carrier formed from the blank 4. Because the carrier is symmetric the distinction in length also facilitates easy identification of one end of the blank 4 from the other. Quick and easy identification of each end of the blank 4 and carrier formed therefrom is particularly important to identify the location of the end of the blank 4 and carrier containing the nick members 29, 39. In the blank 6 of FIG. 6, the tabs 171, 173 associated with one side wall 130 of the carrier are shown longer than the tabs 161, 163 on the other side wall 120 of the blank 6. When the blank 6 is folder over to create a collapsed carrier, a longer and shorter support tab are paired in facing relationship. The difference in lengths of each of the support tabs in a pair facilitates engagement of each tab so that each may be folded into position for attachment to a respective bottom wall. Although the support tabs discussed above are shown as being associated with carrier blanks 4 and 6 respectively, the features of the tabs discussed above may be combined with either or both blanks, and together on one or both blanks. The support tabs are adhered to either the inside or outside of the bottom walls 10, 12, 110, 112 of the erected carrier by know adherent means.

The riser panels 60, 62, 70, 72 are shown as having a nested configuration for ease in fabrication of the blank.

Other modifications may be made in the foregoing without departing from the scope and spirit of the claimed invention. For example, as previously mentioned, although the carrier 2 and blanks 4, 6 are generally illustrated as accommodating of a 3×2 carrier with the center cell portion capable of accommodating one bottle, the invention is equally applicable to other arrays of articles, particularly a 4×2 array with the center cell accommodating two bottles.

What is claimed is:

1. An article carrier comprising:

opposed side walls;

opposed end walls adjoining said opposed side walls;

a handle structure extending between said opposed end walls;

riser panels extending between respective ends of said handle structure and said opposed end walls;

cell forming means extending between each said side wall and said handle structure including bands extending between said handle structure and said side wall; and a bifurcated bottom wall having each side thereof foldably joined to a respective said side wall;

wherein an intersection where each said side wall adjoins a respective said end wall is bevelled; and wherein a juncture of each said band and a respective side wall is bevelled.

2. The carrier of claim 1, wherein each said side wall includes a cut-away portion defining a lower band and an upper band.

3. The carrier of claim 2, wherein said cut-away portion further defines a central member extending between said lower band and said upper band.

4. The carrier of claim 1, further comprising at least one support tab having one end foldably joined to a respective said end wall.

5. The carrier of claim 1, further comprising at least one support tab having one end foldably joined to a respective said riser panel.

6. The carrier of claim 1, further comprising at least one shearable nick member disposed between said bevelled juncture of said band and a respective side wall and an adjacent said side wall when said carrier is in a collapsed condition.

7. A blank for forming an article carrier comprising:

side wall panels;

end wall panels;

first corner tabs respectively foldably joining said side wall panels and said end wall panels such that a bevelled corner is formed thereby between a respective said side wall panel and said end wall panel when the article carrier is erected from the blank;

riser panels each having a first portion foldably joined respectively to said end wall panels;

handle structure panels foldably joined respectively to a second portion of said riser panels adjacent said first portion thereof; and cell forming bands each including a second corner tab foldably joined to a respective one of said side wall panels and a central portion having a first end foldably joined to said handle structure, and having a second end foldably joined to said second corner tab such that a bevelled corner is formed thereby between a respective said side wall panel and said end wall panel when the article carrier is erected from the blank.

8. The blank of claim 7, wherein each said side wall panel includes cut-away portion defining a lower side-wall band and an side-wall upper band.

9. The blank of claim 8, wherein each said cut-away portion further defines a central member extending between said lower side-wall band and said upper side-wall band.

10. The blank of claim 7, further comprising at least one support tab having one end foldably joined to a respective said end wall.

11. The blank of claim 7, further comprising at least one support tab having one end foldably joined to a respective said riser panel.

12. The blank of claim 7, further comprising at least one nick member respectively joining one of said second corner tabs and an adjacent side wall.

* * * * *

UNITED STATES PATENT AND TRADEMARK OFFICE

CERTIFICATE OF CORRECTION

PATENT NO. : 5,547,074

DATED : August 20, 1996

INVENTOR(S) : Plaxico et al.

It is certified that error appears in the above-identified patent and that said Letters Patent is hereby corrected as shown below:

, column 4, line 62 of the Patent, delete "loading. Loading" and substitute --, loading-- therefor.

In claim 8, column 6, line 52 of the Patent, after "includes" insert --a--.

In claim 8, column 6, line 53 of the Patent, reverse the order of "side-wall upper" to read --upper side-wall--.

In the Abstract, 15th line thereof, delete "a".

In Fig. 3 of the Drawings, delete the numeral "2" which denotes the blank and substitute the numeral --4-- therefor.

In Fig. 6 of the Drawings, delete the numeral "2" which denotes the blank and substitute the numeral --6-- therefor.

Signed and Sealed this

Seventeenth Day of June, 1997

Bruce Lehman

*Attest:*

BRUCE LEHMAN

*Attesting Officer*

*Commissioner of Patents and Trademarks*